US010575629B2

(12) United States Patent
Xi et al.

(10) Patent No.: US 10,575,629 B2
(45) Date of Patent: Mar. 3, 2020

(54) BRISTLE AND TOOTHBRUSH INCORPORATING THE SAME

(71) Applicant: Colgate-Palmolive Company, New York, NY (US)

(72) Inventors: Wen Jin Xi, Shanghai (CN); Guang Sheng Guo, Yangzhou (CN); Bo Zhang, Yangzhou (CN)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 15/772,874

(22) PCT Filed: Nov. 3, 2015

(86) PCT No.: PCT/CN2015/093678
§ 371 (c)(1),
(2) Date: May 2, 2018

(87) PCT Pub. No.: WO2017/075761
PCT Pub. Date: May 11, 2017

(65) Prior Publication Data

US 2018/0317644 A1 Nov. 8, 2018

(51) Int. Cl.
*A46D 1/00* (2006.01)
*A46B 9/04* (2006.01)

(52) U.S. Cl.
CPC ..... *A46D 1/0207* (2013.01); *A46B 9/04* (2013.01); *A46D 1/023* (2013.01); *A46D 1/0276* (2013.01); *A46B 2200/1066* (2013.01)

(58) Field of Classification Search
CPC .... A46D 1/0207; A46D 1/023; A46D 1/0276; A46D 1/00; A46D 1/0238; A46B 9/04; A46B 2200/1066; A46B 9/06
See application file for complete search history.

(56) References Cited

U.S. PATENT DOCUMENTS

| | | | | |
|---|---|---|---|---|
| 1,963,389 A * | 6/1934 | Vardeman | A46B 7/04 15/104.94 |
| 5,327,607 A * | 7/1994 | Wagner | A46B 9/045 15/167.2 |
| 5,399,306 A | 3/1995 | Follows et al. | |
| 5,718,954 A | 2/1998 | Sano et al. | |
| 5,853,764 A | 12/1998 | Tsubouchi | |
| 5,991,957 A * | 11/1999 | Watanabe | A46B 9/045 15/167.1 |
| 6,987,138 B2 | 1/2006 | Tokiwa et al. | |
| 8,459,892 B2 | 6/2013 | Sorrentino et al. | |

(Continued)

FOREIGN PATENT DOCUMENTS

| | | |
|---|---|---|
| CN | 1204238 A | 1/1999 |
| CN | 1443500 A | 9/2003 |

(Continued)

OTHER PUBLICATIONS

International Search Report and Written Opinion of the International Searching Authority in International Application No. PCT/CN2015/093678, dated Aug. 3, 2016.

*Primary Examiner* — Robert J Scruggs

(57) ABSTRACT

A bristle and a tooth brush incorporating the same. A toothbrush (100) having a handle (120), a head (110) coupled to the handle (120), and at least one bristle that comprising a composition including a polymer and fibroin particles.

8 Claims, 15 Drawing Sheets

(56) References Cited

U.S. PATENT DOCUMENTS

| | | | | |
|---|---|---|---|---|
| 8,481,681 | B2 | 7/2013 | Sutherland et al. | |
| 9,131,767 | B2 | 9/2015 | Hohlbein et al. | |
| 9,689,089 | B2 | 6/2017 | Ishikawa et al. | |
| 2004/0078910 | A1 | 4/2004 | Grote | |
| 2005/0161058 | A1 | 7/2005 | Yerushalmy | |
| 2007/0151055 | A1* | 7/2007 | Chee | B08B 9/055 15/104.061 |
| 2009/0183324 | A1* | 7/2009 | Fischer | A61C 17/34 15/22.1 |
| 2012/0159731 | A1* | 6/2012 | Liu | D01F 6/92 15/167.1 |
| 2015/0257524 | A1* | 9/2015 | Nakamura | A46D 1/006 15/207.2 |
| 2015/0257525 | A1* | 9/2015 | Kang | A46D 1/0207 15/167.1 |
| 2017/0065070 | A1* | 3/2017 | Hohlbein | A46B 9/04 |

FOREIGN PATENT DOCUMENTS

| | | | |
|---|---|---|---|
| CN | 1176623 | C | 11/2004 |
| CN | 100364472 | C | 8/2006 |
| CN | 1849963 | A | 10/2006 |
| CN | 101278778 | | 10/2008 |
| CN | 101321777 | A | 12/2008 |
| CN | 102618957 | A | 8/2012 |
| CN | 203207468 | A | 9/2013 |
| CN | 203913861 | U | 11/2014 |
| EP | 2123189 | | 11/2009 |
| JP | H11-299540 | | 11/1999 |
| JP | 2005000310 | | 1/2005 |
| JP | 2011-110069 | A | 6/2011 |
| KR | 1020010025486 | | 4/2001 |
| KR | 100431669 | | 5/2004 |
| WO | 1997016995 | | 5/1997 |
| WO | 2009/000903 | | 12/2008 |
| WO | 2014/001831 | | 1/2014 |

* cited by examiner

BRISTLE AND TOOTHBRUSH INCORPORATING THE SAME

BACKGROUND

Toothbrushes are typically used by applying toothpaste or dentifrice to a bristle section on the head of the toothbrush, followed by brushing regions of the oral cavity (e.g., the teeth or soft tissue such as the tongue and/or gums) with the bristle section. However, there still remains room for improvement in toothbrush design as consumers are constantly looking for a better mouth feel during and after brushing and more effective teeth cleaning and whitening as a result of brushing. Thus, a need exists for an oral care implement that more effectively and efficiently cleans a user's teeth and other oral surfaces while providing a comfortable mouth feel during use.

BRIEF SUMMARY

In one aspect, the present invention is a toothbrush comprising a handle, a head coupled to the handle; and at least one bristle comprising a composition including a polymer and fibroin particles. The at least one bristle can be part of a bristle tuft.

In other aspects, the present invention is a method of forming bristles comprising mixing fibroin particles into a polymer resin to form a mixture and forming a plurality of bristles from the mixture.

In a further aspect, the invention may be a bristle comprising a composition comprising a polymer and fibroin particles dispersed throughout the polymer.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
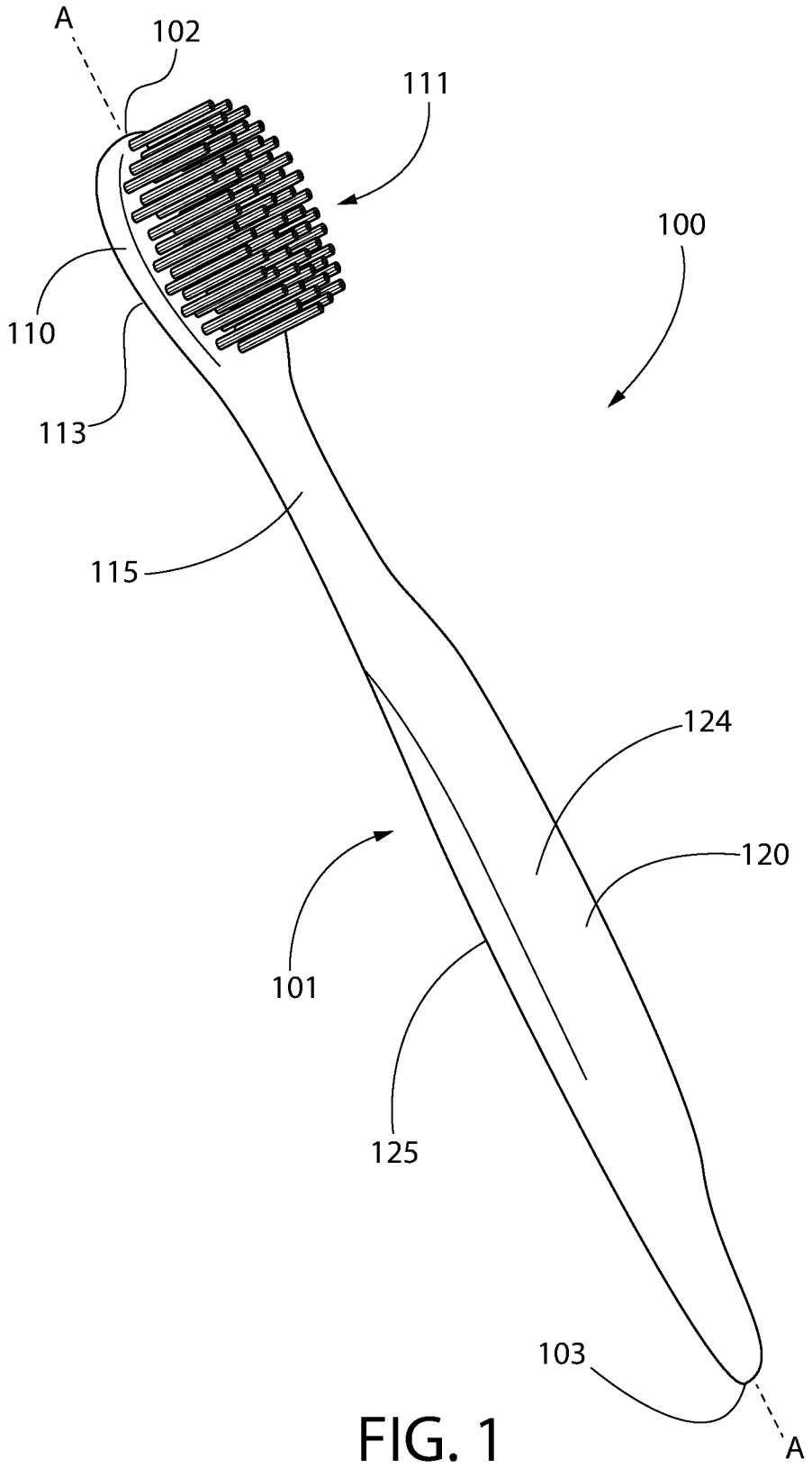
FIG. 1 is a front perspective view of an oral care implement having bristles according to an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

Referring first to FIG. 1, an oral care implement 100 is illustrated in accordance with an embodiment of the present invention. In the exemplified embodiment, the oral care implement 100 is in the form of a manual toothbrush. However, in certain other embodiments the oral care implement 100 can take on other forms such as being a powered toothbrush, a tongue scraper, a gum and soft tissue cleanser, a water pick, an interdental device, a tooth polisher, a specially designed ansate implement having tooth engaging elements or any other type of implement that is commonly used for oral care. Thus, it is to be understood that the inventive concepts discussed herein can be applied to any type of oral care implement unless a specific type of oral care implement is specified in the claims.

The oral care implement extends from a proximal end 103 to a distal end 102 along a longitudinal axis A-A. The oral care implement 100 generally includes an elongated body 101 comprising a head 110, a neck 115 and a handle 120. The handle 120 is an elongated structure that provides the mechanism by which the user can hold and manipulate the oral care implement 100 during use. The handle 120 comprises a front surface 124 and an opposing rear surface 125. In the exemplified embodiment, the handle 120 is generically depicted having various contours for user comfort. More specifically, in the exemplified embodiment the handle 120 is bulbous shaped and has a larger diameter in a central region than near the proximal end 103 and neck 115. Specifically, a region of the handle 120 that would normally be gripped by a user's thumb has a width that is greater than a width of the neck 115. Of course, the invention is not to be so limited in all embodiments and in certain other embodiments the handle 120 can take on a wide variety of shapes, contours and configurations, none of which are limiting of the present invention unless so specified in the claims.

In the exemplified embodiment, the handle 120 is formed of a rigid plastic material, such as for example without limitation polymers and copolymers of ethylene, propylene, butadiene, vinyl compounds and polyesters such as polyethylene terephthalate. Of course, the invention is not to be so limited in all embodiments and the handle 120 may include a resilient material, such as a thermoplastic elastomer, as a grip cover that is molded over portions of or the entirety of the handle 120 to enhance the gripability of the handle 120 during use. For example, portions of the handle 120 that are typically gripped by a user's palm during use may be overmolded with a thermoplastic elastomer or other resilient material to further increase comfort to a user.

The head 110 of the oral care implement 100 is coupled to the handle 120 and comprises a front surface 112 and an opposing rear surface 113. In the exemplified embodiment, the head 110 is formed integrally with the handle 120 as a single unitary structure using a molding, milling, machining or other suitable process. However, in other embodiments the handle 120 and the head 110 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners.

In the exemplified embodiment, the head 110 of the oral care implement 100 is provided with a plurality of tooth cleaning elements 111 extending from the front surface 112. Although in the exemplified embodiment all of the tooth cleaning elements 111 appear to be the same, the invention is not to be so limited in all embodiments. For example, in certain embodiments the tooth cleaning elements 111 include at least one bristle tuft comprising at least one bristle. The details of various structural forms for a bristle will be described in more detail below with reference to FIGS. 2-6.

A bristle tuft is a collection of bristles that are positioned together into a single tuft hole formed on the head 110. Each bristle tuft may include, for example without limitation, only multi-component bristles, a combination of multi-component bristles and single-component (i.e., traditional) bristles, or only single-component bristles. In certain embodiments, the oral care implement 100 may include one or more bristle tufts that include exactly one multi-component bristle and a plurality of single-component bristles or one or more bristle tufts that include only multi-component bristles. In still other embodiments, the tooth cleaning elements 111 may all be formed as bristle tufts that are formed solely of multi-component bristles. Furthermore, in some embodiments the tooth cleaning elements 111 may include some bristle tufts that are formed solely of single-component bristles and some bristle tufts that are formed solely of multi-component bristles, and the single-component bristle tufts and multi-component bristle tufts may be positioned on the head 110 of the oral care implement 100 in an alternating or non-alternating fashion (i.e., alternating or non-alternating transverse rows of bristle tufts, alternating or non-alternating longitudinal rows of bristles, or even alternating or non-alternating tufts in each row).

The exact structure, pattern, orientation and material of the remainder of the tooth cleaning elements 111 is not to be limiting of the present invention unless so specified in the claims. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, spiral bristles, elastomeric protrusions, flexible polymer protrusions, combinations thereof and/or structures containing such materials or combinations. At least some of the tooth cleaning elements may be formed of rubber-like materials such as thermoplastic elastomers in certain embodiments.

The tooth cleaning elements 111 of the present invention can be connected to the head 110 in any manner known in the art. For example, staples/anchors, in-mold tufting (IMT) or anchor free tufting (AFT) could be used to mount the cleaning elements/tooth engaging elements. In certain embodiments, the invention can be practiced with various combinations of stapled, IMT or AFT bristles. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

In the exemplified embodiment, the head 110 of the oral care implement 100 comprises a plurality of tuft holes (not visible) formed therein. A plurality of tufts of bristles are positioned within and affixed to the head 110 within each of the tuft holes. Each of the tufts of bristles includes a plurality of bristles, which can be single strand bristles, double strand multi-component bristles, triple strand multi-component bristles, etc. or various combinations thereof. Thus, one tuft of bristles may include one double strand multi-component bristle and a plurality of single strand bristles or only double strand multi-component bristles or only triple strand multi-component bristles or a combination of single strand bristles, double strand multi-component bristles and triple strand multi-component bristles. Additionally, a single tuft hole may be filled with an elastomeric cleaning element or any of the other types of cleaning elements noted above. As noted above, in one embodiment at least one bristle tuft includes at least one multi-component bristle, which may be a double, triple or otherwise strand multi-component bristle. The details of the multi-component bristles will be discussed in more detail below with reference to FIGS. 2-6.

Although not illustrated herein, in certain embodiments the head 110 may also include a soft tissue cleanser coupled to or positioned on its rear surface 113. An example of a suitable soft tissue cleanser that may be used with the present invention and positioned on the rear surface of the head 110 is disclosed in U.S. Pat. No. 7,143,462, issued Dec. 5, 2006 to the assignee of the present application, the entirety of which is hereby incorporated by reference. In certain other embodiments, the soft tissue cleanser may include protuberances, which can take the form of elongated ridges, nubs, or combinations thereof. Of course, the invention is not to be so limited and in certain embodiments the oral care implement 100 may not include any soft tissue cleanser.

As discussed herein, the bristle of the present invention may also be referred to as a mono-filament. As illustrated in FIGS. 2A-2C and 3A-3C, the bristle of the present invention may be a single-component bristle 200, 300 integrally formed from a composition comprising a polymer and a fibroin powder. As illustrated in FIGS. 4A-4C and 5A-5C, in other embodiments the bristle may be a multi-component bristle 400, 500 comprising a sheath component 420, 520, and a core component 410, 510, wherein either the sheath component or the core component may be formed from only the composition (polymer and fibroin powder) of the present invention, as discussed further herein. These different embodiments will be described in more detail below with specific reference to the figures.

Figure 2A:
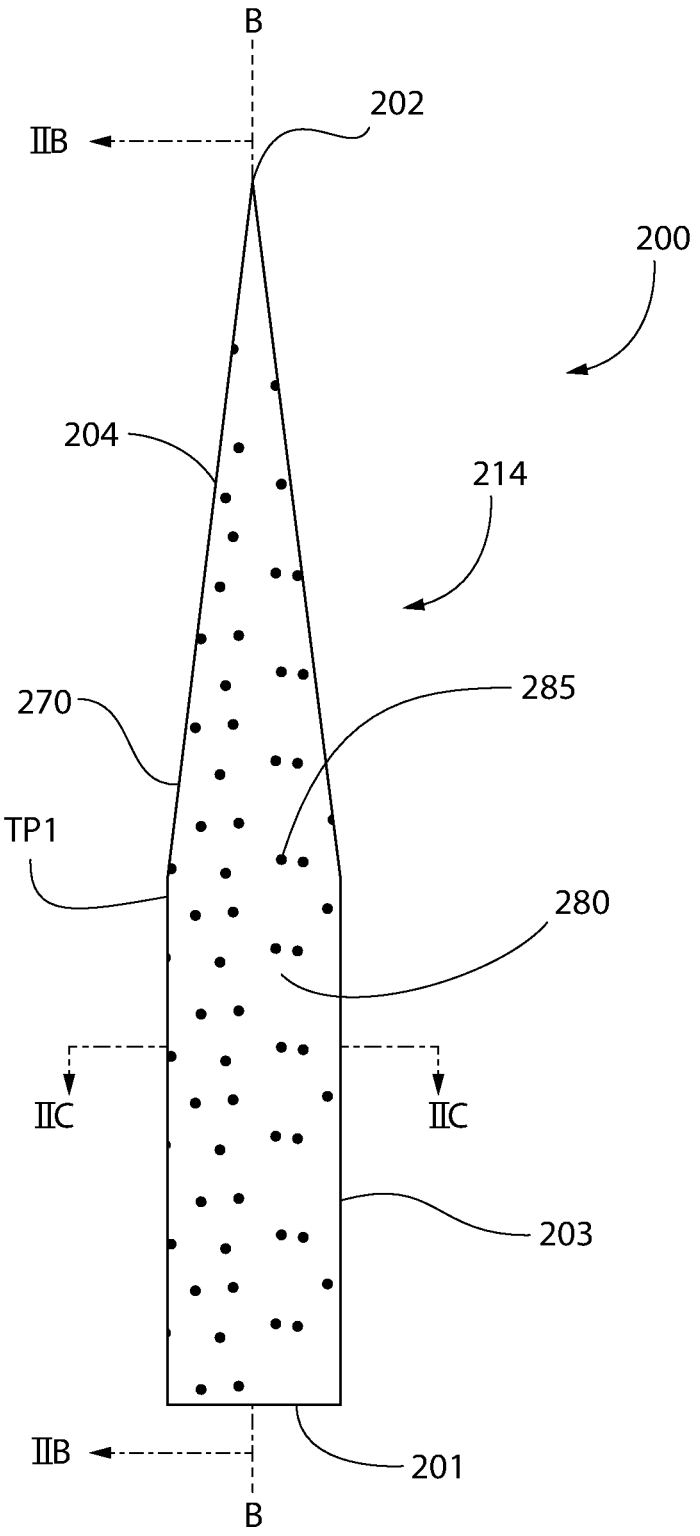
FIG. 2A is a front perspective view of a single-component bristle in accordance with an embodiment of the present invention.
Figure 2B:
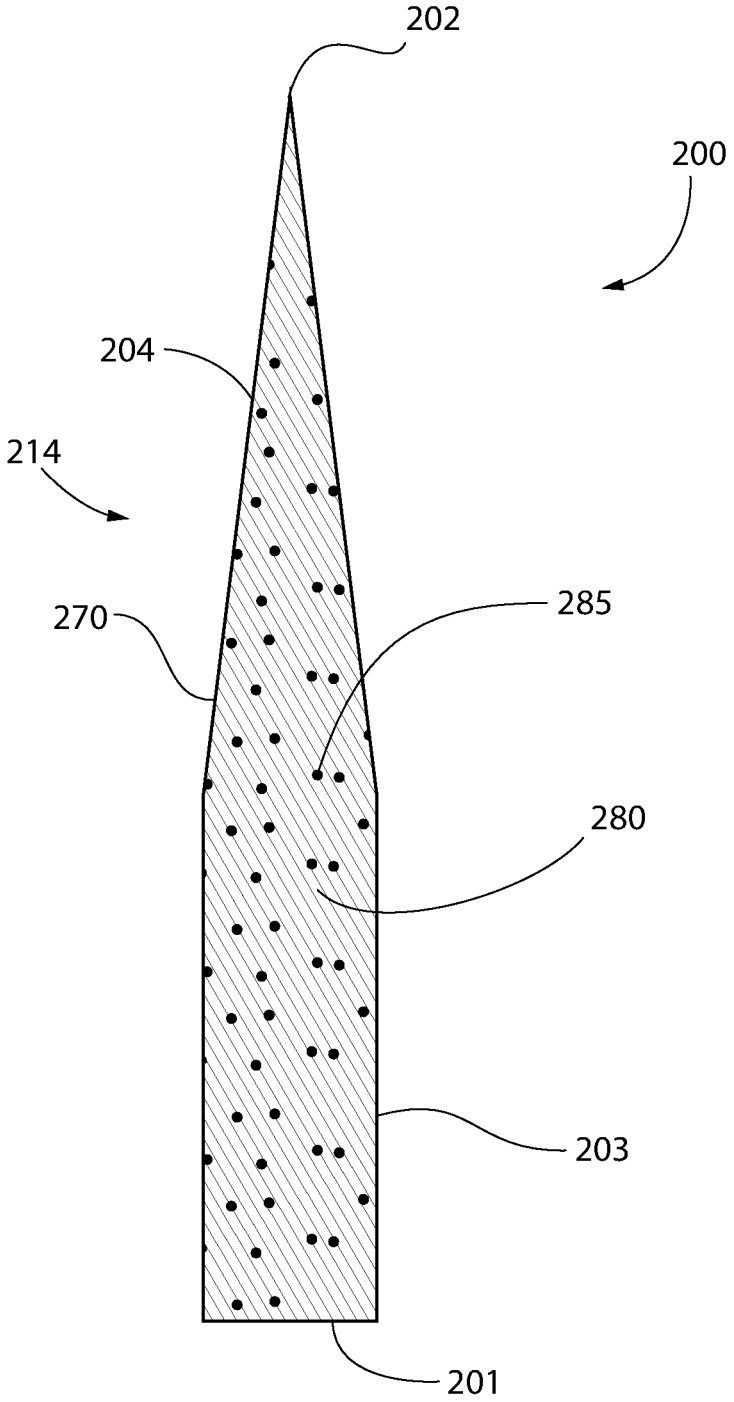
FIG. 2B is a cross-sectional view taken along line IIB-IIB in FIG. 2A.
Figure 2C:
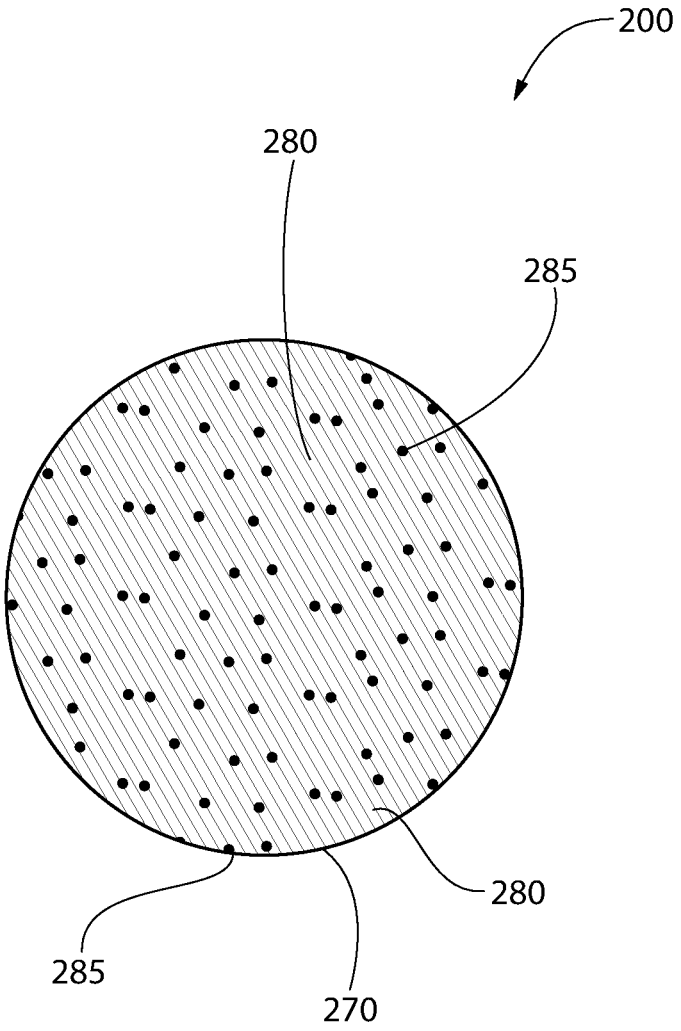
FIG. 2C is a cross-sectional view taken along line IIC-IIC in FIG. 2A.

Referring to FIGS. 2A-2C concurrently, an embodiment of a single-component bristle 200 will be described. The single-component bristle 200 extends from a base end 201 to a free end 202 along a longitudinal axis B-B. The single-component bristle 200 may also comprise a base portion 203, a distal tip portion 204, and an outer surface 270. The base portion 203 extends from the base end 201 to a transition point TP1 and the distal tip portion 204 extends from the transition point TP1 to the free end 202. In the exemplified embodiment, the distal tip portion 204 transitions from the base portion 203 at the first transition point TP1. The base end 201 of the single-component bristle 200 may be anchored to the head 110 of the oral care implement 100 of the present invention in any manner such as those described above, thereby leaving the free end 202 available to contact surfaces within an oral cavity during cleaning.

The cross-sectional geometry of the single-component bristle 200 may be circular. In other embodiments, the cross-sectional geometry of the single-component bristle 200 may be ovular or polygonal—including, but not limited to triangular, rectangular, trapezoidal, heptagonal, hexagonal. Bristles having polygonal cross-sectional geometry may comprise longitudinal edges that allow the bristle to act as a wiping blade or squeegee element further enhancing the cleaning effect of the bristle on an oral cavity surface (e.g., tooth surface, gum surface) as discussed further herein below with reference to FIGS. 6A-8B.

Referring only to FIGS. 2A and 2B, the base portion 203 of the single-component bristle 200 may have a substantially constant transverse cross-sectional area and the distal tip portion 204 may have a transverse cross-sectional area that decreases with increasing distance from the head 110 of the oral care implement 100. According to the present invention, the phrase "substantially constant" means variation less than 1%. In certain embodiments the transverse cross-sectional area of the base portion 203 remains constant as measured from the base end 201 to the first transition point TP1 and the distal tip portion 204 has a cross-sectional area that decrease as measured from the first transition point TP1 to the free end 202.

The decreasing transverse cross-sectional area in the distal tip portion 204 creates the single-component bristle 200 having a tapered section 214 extending from the first transition point TP1 to the free end 202 of the single-component bristle 200. The free end 202 of the tapered single-component bristle 200 may culminate at an apex that is opposite the base end 201 of the single-component bristle 200 along the B-B axis. The taper may be continuous from the transition point TP1 to the free end 202 of the single-component bristle 200.

Figure 3A:
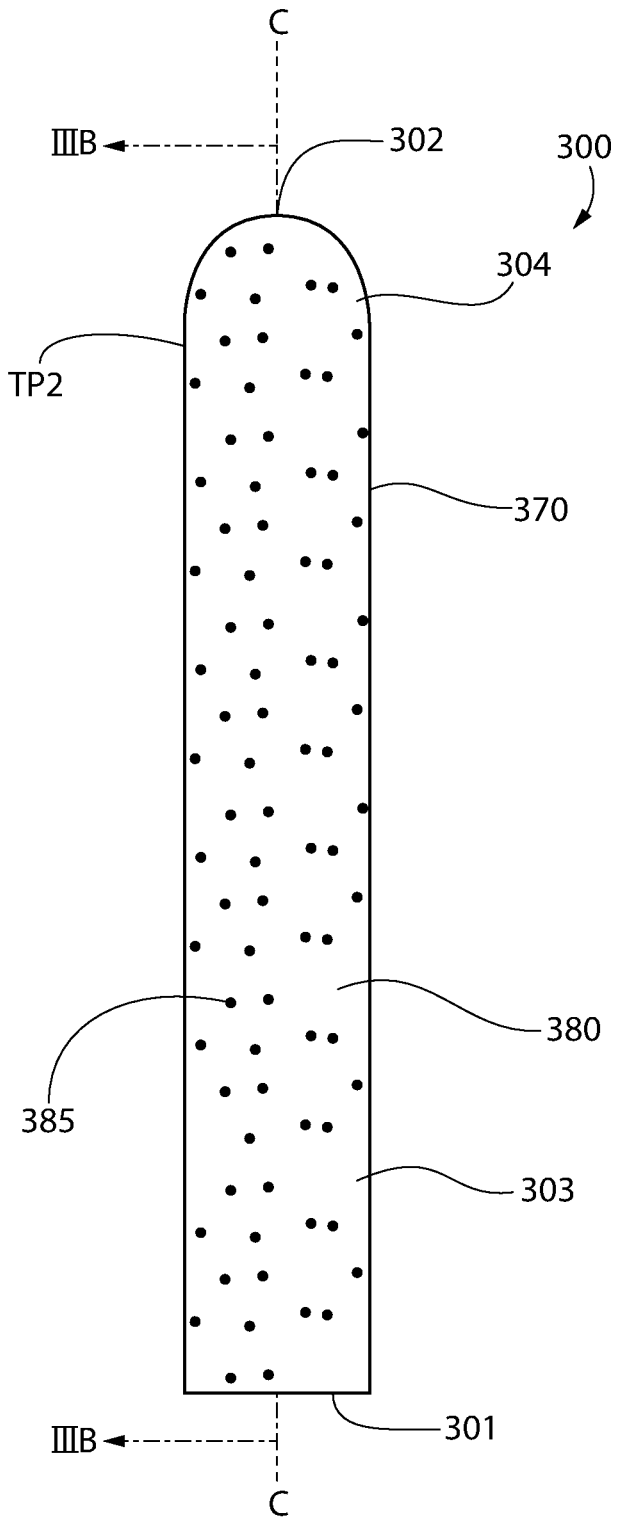
FIG. 3A is a front perspective view of a single-component bristle in accordance with an embodiment of the present invention.
Figure 3B:
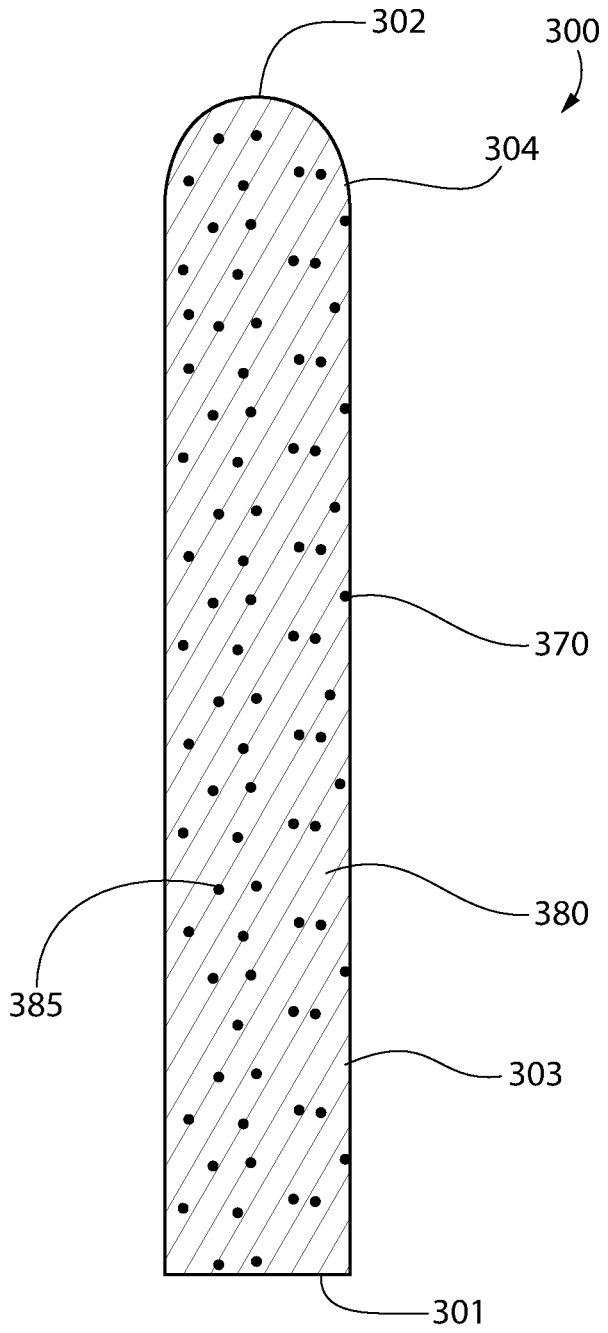
FIG. 3B is a cross-sectional view taken along line IIIB-IIIB in FIG. 3A

Referring now only to FIGS. 3A-3B, a single-component bristle 300 will be described in accordance with another embodiment of the present invention. The bristle 300 is similar to the bristle 200 except for the differences described herein below. The features of the bristle 300 that are described above with regard to the bristle 200 will not be repeated herein in the interest of brevity, it being understood that the description above with regard to the bristle 200 applies. Furthermore, features of the bristle 300 will be similarly numbered as similar features on the bristle 200 except that the 300-series of numbers will be used. For features of the bristle 300 that are numbered but not described, it should be understood that the description of the similar feature in the bristle 200 applies.

The single-component bristle 300 may have a base portion 303 that has a substantially constant transverse cross-sectional area as well as a distal tip portion 304 that has a substantially constant transverse cross-sectional area. The distal tip portion 304 may have a substantially constant cross-sectional area where the free end 302 of the single-component bristle 300 is rounded rather than tapered. In the exemplified embodiment, the single-component bristle 300 begins to be rounded at a second transition point TP2. The rounded free end 302 of the single-component bristle 300 may be hemi-spherical. Thus, the bristle 300 is identical to the bristle 200 except that the bristle 300 is not tapered but has a rounded free end.

Referring now to the embodiments of FIGS. 2A-2C and 3A-3B concurrently, the single-component bristles 200, 300 of the present invention may be integrally formed from a single composition of a polymer 280, 380 and a fibroin powder 285, 285. The polymer 280, 380 may form a three-dimensional network in which the fibroin particles 285, 385 are uniformly distributed throughout. The uniform distribution of the fibroin particles 285, 385 throughout the polymer 280, 380 may ensure that at least a portion of the outer surface 270, 370 of the single-component bristles 200, 300 comprises the fibroin particles 285, 385 as well as the polymer 280, 380.

Figure 4A:
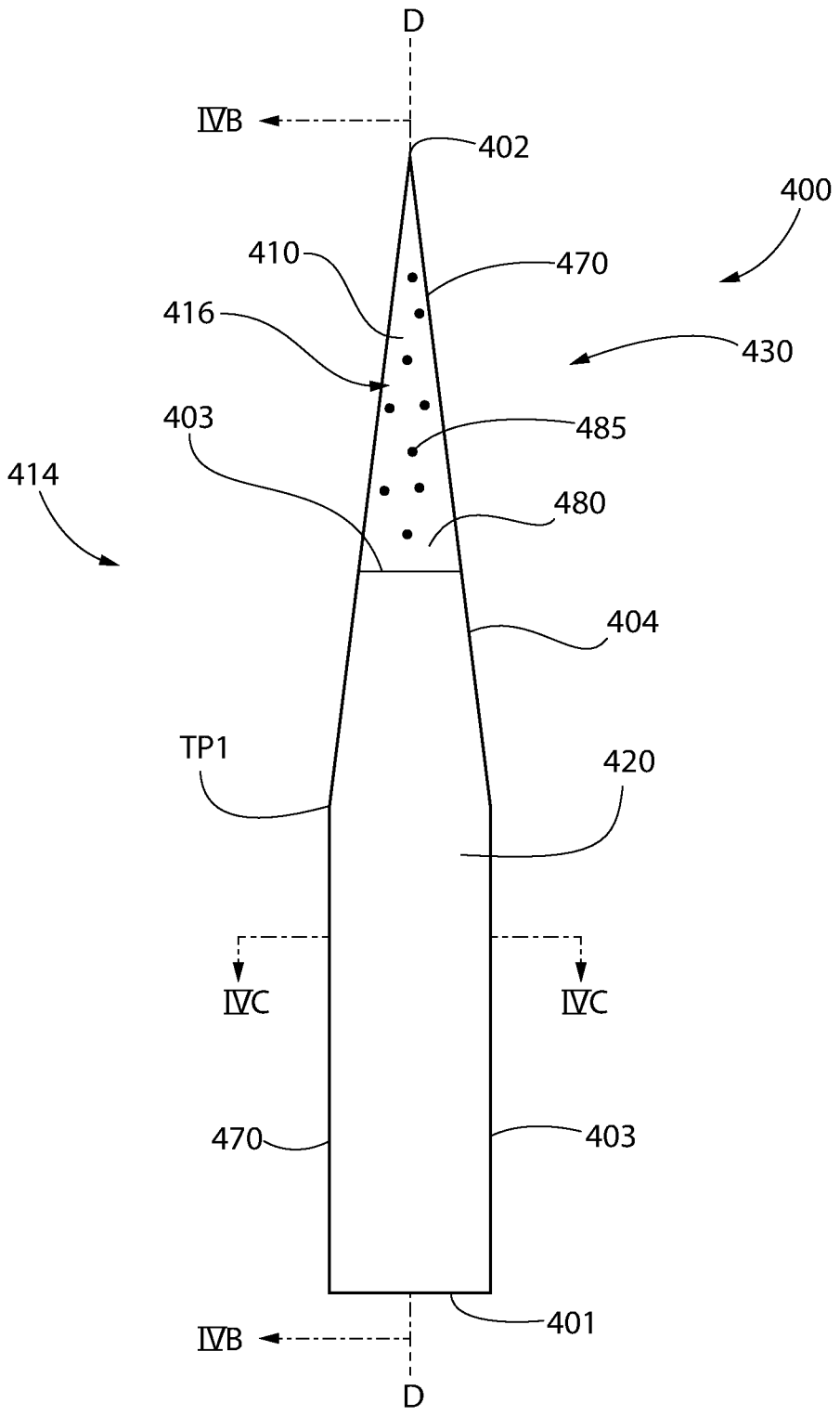
FIG. 4A is a front perspective view of a multi-component bristle in accordance with an embodiment of the present invention.
Figure 4B:
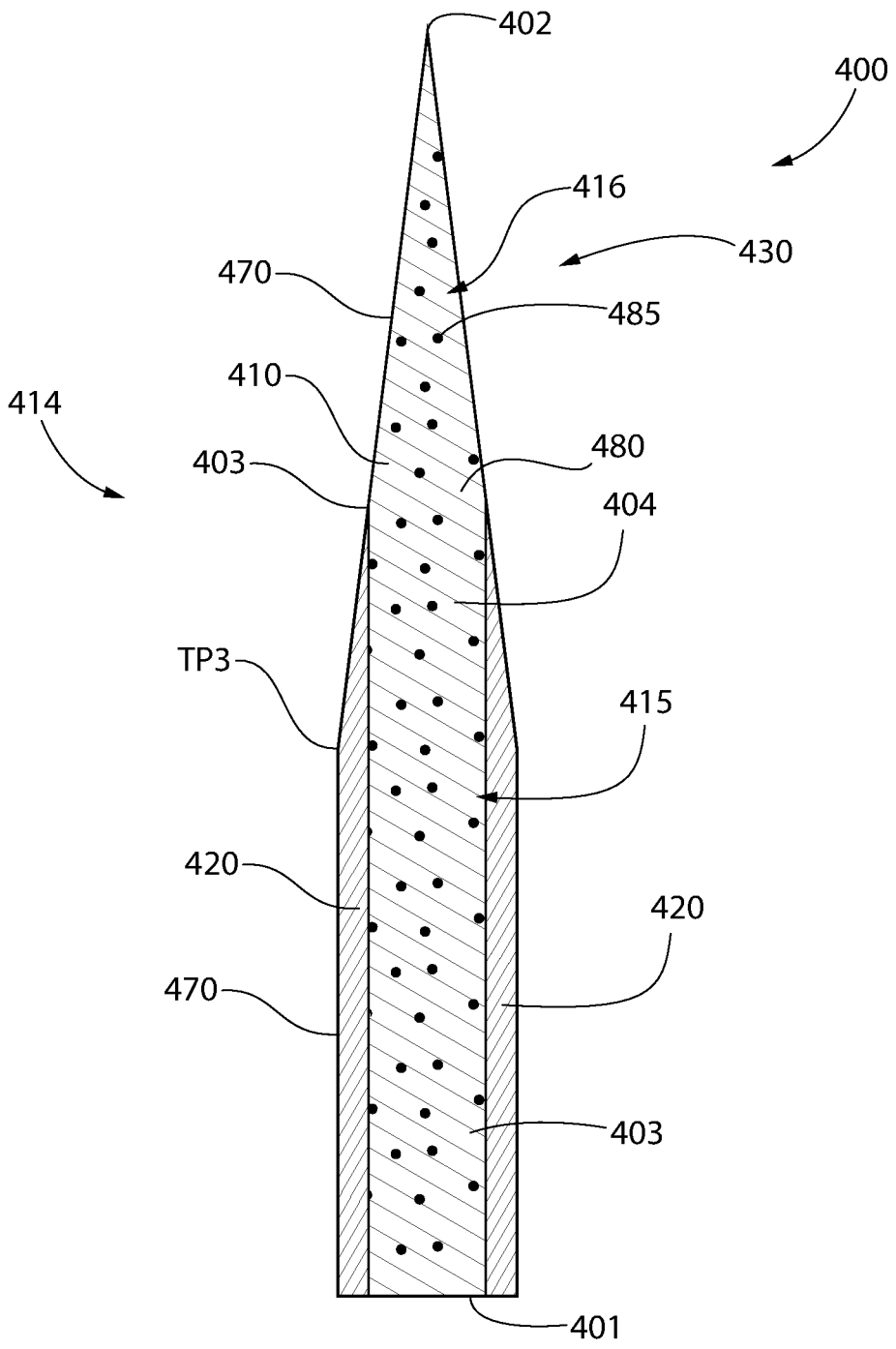
FIG. 4B is a cross-sectional view taken along line IVB-IVB of FIG. 4A.
Figure 4C:
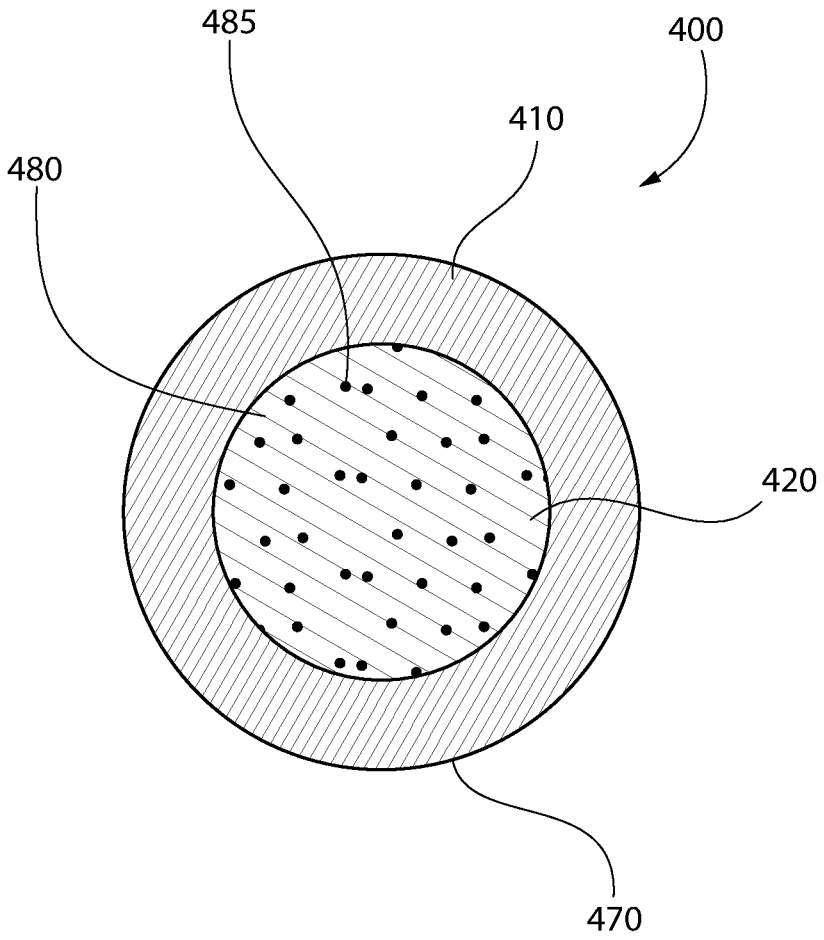
FIG. 4C is a cross-sectional view taken along line IVC-IVC of FIG. 4A.

Referring now to FIGS. 4A-4C concurrently, one exemplary embodiment of a multi-component bristle 400 will be described. In the exemplified embodiment, the multi-component bristle 400 extends from a base end 401 to a free end 402 along a longitudinal axis D-D. The multi-component bristle 400 may further comprise a base portion 403, a distal tip portion 404, and an outer surface 470. The base portion 403 extends from the base end 401 to the distal tip portion 404 and the distal tip portion 404 extends from the base portion 403 to the free end 402. In the exemplified embodiment, the distal tip portion 404 transitions from the base portion 403 at a third transition point TP3. The base end 401 of the multi-component bristle 400 may anchored to the head 110 of the oral care implement 100 of the present invention, thereby leaving the free end 402 uncoupled and available to contact surfaces within an oral cavity during cleaning.

The cross-sectional geometry of the multi-component bristle 400 may be circular. In other embodiments, the cross-sectional geometry of the multi-component bristle 400 may be ovular or polygonal—including, but not limited to triangular, rectangular, trapezoidal, heptagonal, hexagonal. Bristles having polygonal cross-sectional geometry may comprise longitudinal edges that allow the bristle to act as a wiping blade or squeegee element further enhancing the cleaning effect of the bristle on an oral cavity surface (e.g., tooth surface, gum surface) as discussed further herein with specific reference to FIGS. 6A-8B.

The base portion 403 of the multi-component bristle 400 may have a substantially constant transverse cross-sectional area and the distal tip portion 404 may have a transverse cross-sectional area that decreases with increasing distance from the head 110 of the oral care implement 100. Stated another way, the transverse cross-sectional area of the base portion 403 remains constant as measured from the base end 401 to the third transition point TP3 and the distal tip portion 404 has a cross-sectional area that decrease as measured from the third transition point TP3 to the feed end 402.

The decreasing transverse cross-sectional area in the distal tip portion 404 creates the multi-component bristle 400 having a tapered section 414 extending from the third transition point TP3 to the free end 402 of the multi-component bristle 400. The free end 402 of the tapered single-component bristle 400 may culminate at an apex that is opposite the base end 401 of the single-component bristle 400 along the D-D axis. The taper is continuous from the third transition point TP3 to the free end 402 of the single-component bristle 400. In other embodiments, the base portion 403 and the distal tip portion 404 may both have decrease cross-sections as measured from base end 401 to the free end 402, thereby creating a continuous longitudinal edge portion of the multi-component bristle 400.

In the exemplified embodiment, the multi-component bristle 400 comprises a core component 410 and a sheath component 420 that are coextruded to form the multi-component bristle 400. Stated another way, the multi-component bristle 400 comprises the coextruded core and sheath components 410, 420. In the exemplified embodiment, the sheath component 420 surrounds a first portion 415 of the core component 410 and a second portion 416 of the core component 410 protrudes from the sheath component 420 at a tip portion 430 of the multi-component bristle 400. The second portion 416 of the core component 410 is therefore exposed whereas the first portion 415 of the core component 410 is not exposed but rather is entirely surrounded by the sheath component 420. Thus, at least a portion of each of the core and sheath components 410, 420 is visible from an exterior of the multi-component bristle 400, and more specifically an entirety of the sheath component 420 is visible and the second portion 416 of the core component 410 is visible from the exterior of the multi-component bristle 400.

In the exemplified embodiment, each of the core and sheath components 410, 420 extend all the way to the base end 401 of the multi-component bristle 400, although the invention is not to be so limited in this regard in all embodiments. The core component 410 extends from the base end 401 of the multi-component bristle 400 to the free end 402 of the multi-component bristle 400. The sheath component 420 extends from the base end 401 of the multi-component bristle 400 to a terminal end 403 of the sheath component 420. In the exemplified embodiment, the second portion 416 of the core component 410 makes up between approximately 15-20% of the total length of the multi-component bristle 400, more specifically between approximately 17-23% of the total length of the multi-component bristle 400, and even more specifically between approximately 20-22% of the total length of the multi-component bristle 400. In another embodiment, the exposed second portion 416 of the core component 410 may make up between approximately 10-15%, and more specifically between approximately 12-13% of the total length of the multi-component bristle 400. Furthermore, the sheath component 420 extends approximately 75-80% of the total length of the multi-component bristle 400, more specifically approximately 77-83% of the total length of the multi-component bristle 400, and even more specifically between approximately 78-80% of the total length of the multi-component bristle 400, or between approximately 85-90% or 87-88% of the total length of the multi-component bristle 400.

In the exemplified embodiment, the multi-component bristle 400 has a cylindrical cross-sectional shape. Furthermore, the core component 410 has a cylindrical cross-sectional shape and the sheath component 420 has a ring-like shape that circumferentially and concentrically surrounds the core component 410 for at least part of the length of the core component 410. Of course, the invention is not to be so limited and the core component 410 can take on other polygonal shapes as desired and the shape of the sheath component 420 can likewise change so long as the sheath component 420 circumferentially surrounds the core component 410 for at least a portion of the length of the core component 410.

Referring again to FIGS. 4A-4C, the sheath component 420 may be a secondary composition comprising polymer (e.g. nylon, PET, PBT, rubber) while being free of fibroin powder 485 and the core component 410 is formed from a composition comprising a polymer 480 and a fibroin powder 485 uniformly distributed throughout.

Figure 5A:
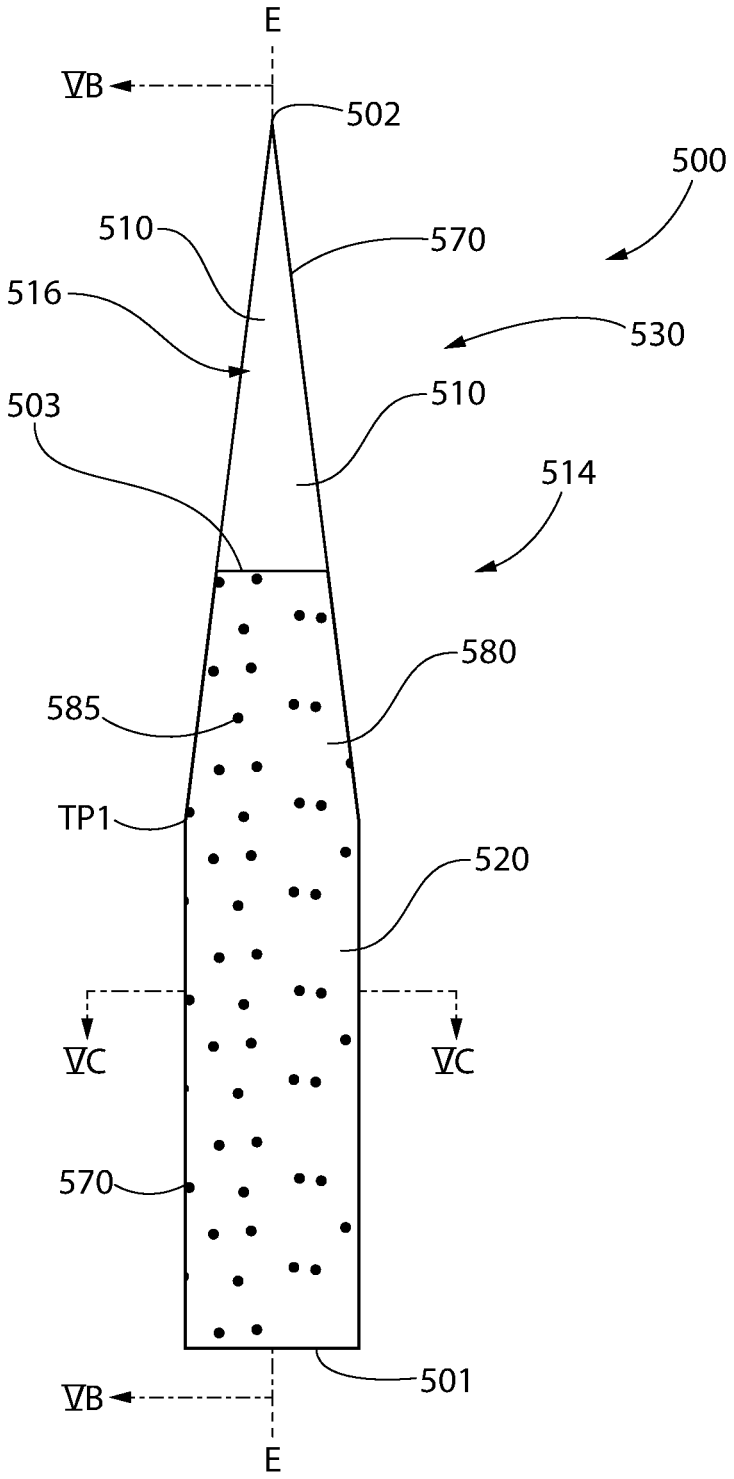
FIG. 5A is a front perspective view of a multi-component bristle in accordance with another embodiment of the present invention.
Figure 5B:
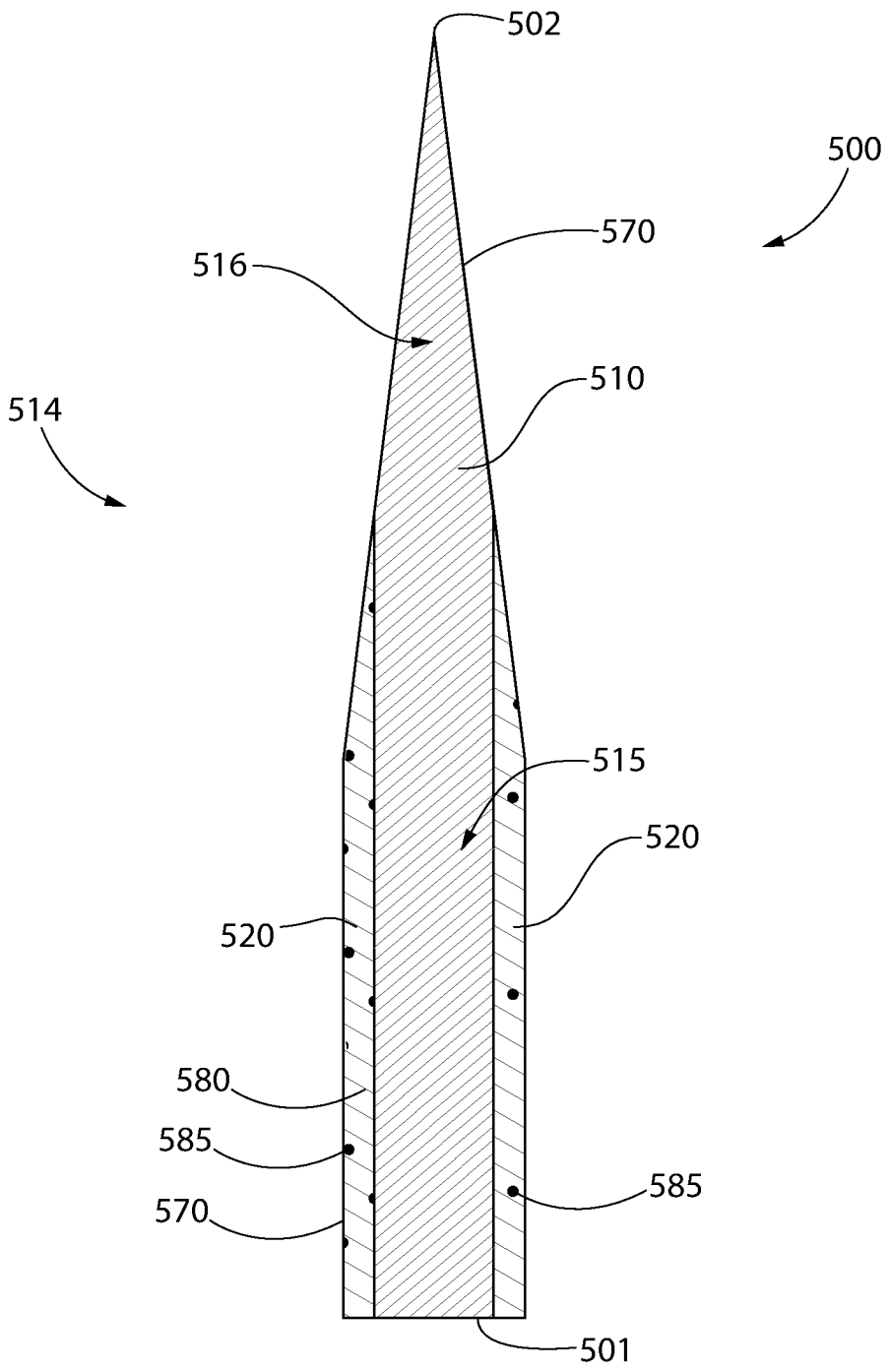
FIG. 5B is a cross-sectional view taken along line VB-VB of FIG. 5A.
Figure 5C:
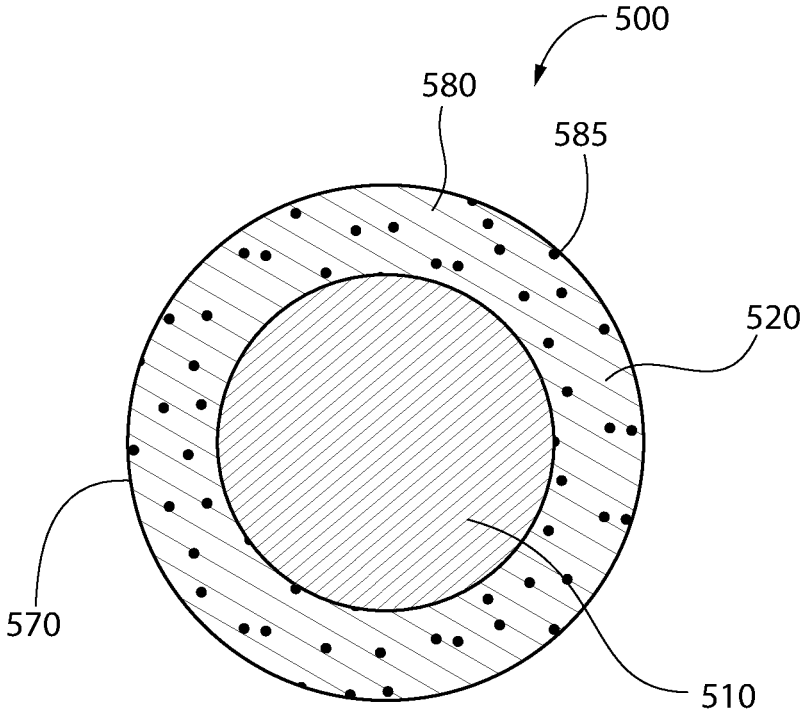
FIG. 5C is a cross-sectional view taken along line VC-VC of FIG. 5A.

Referring now only to FIGS. 5A-5C, a multi-component bristle 500 is illustrated in accordance with another embodiment of the present invention. The multi-component bristle 500 is similar to the multi-component bristle 400 except for the differences described herein below. The features of the multi-component bristle 500 that are described above with regard to the multi-component bristle 400 will not be repeated herein in the interest of brevity, it being understood that the description above with regard to the multi-component bristle 400 applies. Furthermore, features of the multi-component bristle 500 will be similarly numbered as similar features on the multi-component bristle 400 except that the 500-series of numbers will be used. For features of multi-component the bristle 500 that are numbered but not described, it should be understood that the description of the similar feature in the multi-component bristle 400 applies.

The multi-component bristle 500 comprises a core component 510 and a sheath component 520 that are similar to the same components of the multi-component bristle 400 described above. In this embodiment, the core component 510 may be a secondary composition that comprises polymer (e.g., nylon, PET, PBT, rubber) while being free of fibroin powder and the sheath component 520 may be formed from a composition comprising a polymer 580 and a fibroin powder 485 uniformly disturbed throughout. Thus, the multi-component bristle 500 has the opposite arrangement to the multi-component bristle in terms of composition. In the multi-component bristle 400 the sheath component 420 is free of fibroin powder (and may comprise only a polymer) and the core component comprises a polymer and a fibroin powder. In the multi-component bristle 500 the core component 510 is free of fibroin powder (and may comprise only a polymer) and the sheath component 520 comprises a polymer and a fibroin powder Although the multi-component bristles 400, 500 are described herein as having two different components, the invention is not to be so limited and in other embodiments, three, four, five or more different components/layers can be used, each of which has a different oral care additive or any combination of the same and different oral care additives and lack thereof. A combination of different two component (or more) multi-component bristles can be utilized on the same oral care implement head wherein each component has different oral care agents/additives. For example, an oral care implement may include tooth cleaning elements disposed in transverse rows on the head. Each transverse row may include bristle tufts including multi-component bristles in one transverse row including different oral care additives than the multi-component bristles in each other or each adjacent transverse row. A virtually unlimited number of different combinations of the multi-component bristles described herein are possible.

Referring now to FIG. 6A-8B, as described above in certain embodiments the bristles may have a polygonal or non-circular shape. Specifically, referring first to FIGS. 6A and 6B, one example of a polygonal bristle 600 will be described. In this embodiment, the bristle 600 has a polygonal shape with a triangular transverse cross-sectional area. The bristle 600 may be adequately described as having the shape of a triangular column. The bristle 600 may be formed of the same material(s) as the other bristles described herein, the difference being the specific shape of the bristle 600. Thus, the bristle 600 may be single component or multiple component and may include a polymer and fibroin particles as described herein above.

The bristle 600 extends along a longitudinal axis C-C and comprises three longitudinal surfaces 601, 602, 603. Each of the longitudinal surfaces 601-603 is elongated along the longitudinal axis E-E. The longitudinal surfaces 601 that are adjacent to one another intersect at a longitudinal edge 611, 612, 613. Each of the longitudinal edges 611-613 is elongated along the longitudinal axis C-C. More specifically, the longitudinal surfaces 601, 602 intersect at the longitudinal edge 611, the longitudinal surfaces 602, 603 intersect at the longitudinal edge 612, and the longitudinal surfaces 601, 603 intersect at the longitudinal edge 613. Thus, each of the longitudinal edges 611-613 is an apex formed at the intersection of two adjacent longitudinal surfaces 601-603. Each of the longitudinal edges 611-613 forms a wiping blade or squeegee that may enhance the cleaning or scraping effect of the bristle on an oral cavity surface such as a user's tooth.

In the exemplified embodiment, the bristle 600 comprises a base portion 620 and a distal tip portion 630 that both have decreasing cross-sectional areas. Specifically, the base portion 620 may have a decreasing cross-sectional area as measured from a base end 621 of the bristle 600 to a transition point TP1, and the distal tip portion 630 may have a decreasing cross-sectional area as measured from the transition point TP1 to a free end 631 of the bristle 600. Thus, in certain embodiments the bristle 600 may be a fully tapered bristle (tapering along its entire length), a partially tapered bristle (tapering along part of its length similar to the bristle 200), or the bristle 600 may be rounded.

Figure 6A:
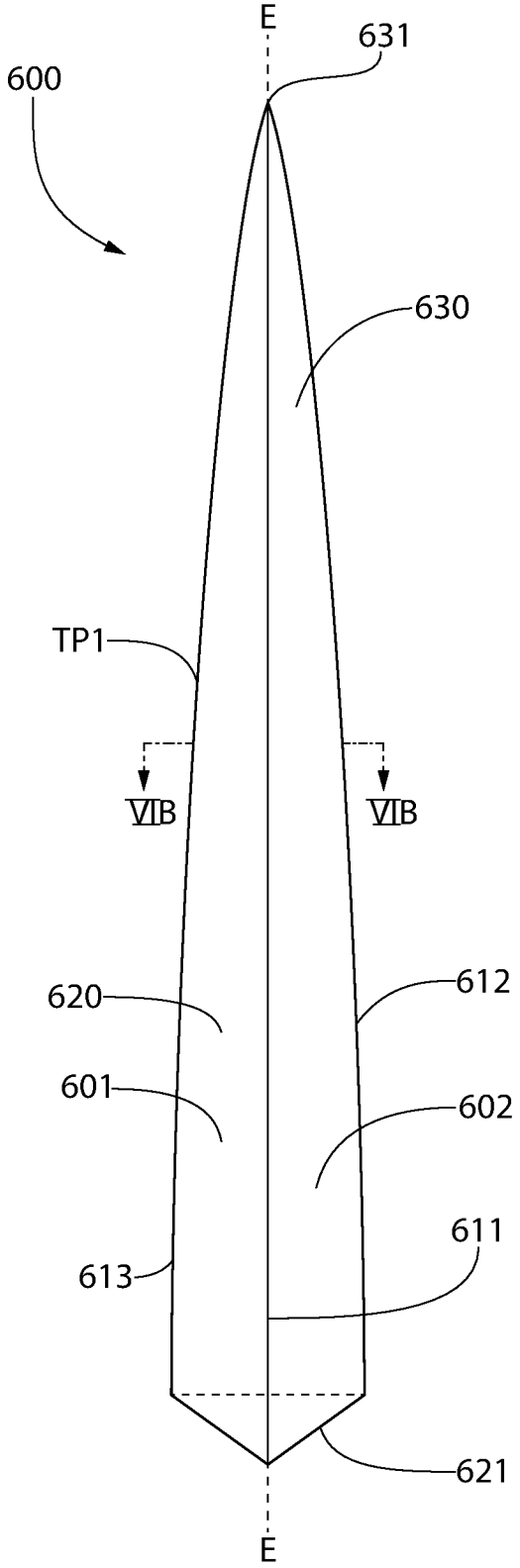
FIG. 6A is a front perspective view of a polygonal bristle in accordance a first embodiment of the present invention.

As demonstrated in FIG. 6A, the transition point TP1 between the base portion 620 and the distal tip portion 630 may be smooth, thereby resulting in continuous longitudinal edges 611-613 that extend continuously from the base end 621 to the free end 631 without interruption by bumps, ridges, edges, points, or grooves. In the embodiment of the bristle 600 illustrated in FIGS. 6A and 6B, there are three longitudinal surfaces 601-603 and three longitudinal edges 611-613. However, the invention is not to be so limited in all embodiments and the number of longitudinal edges 611-613 690 and longitudinal surfaces 601-603 will depend on the cross-sectional geometry.

Figure 6B:
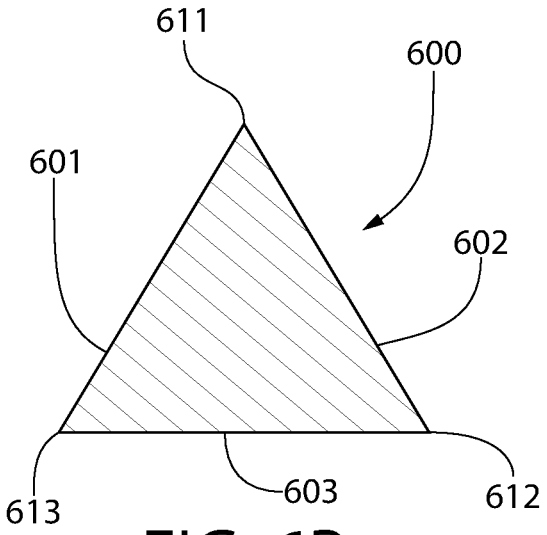
FIG. 6B is a cross-sectional view taken along line VIB-VIB of FIG. 6A.
Figure 7A:
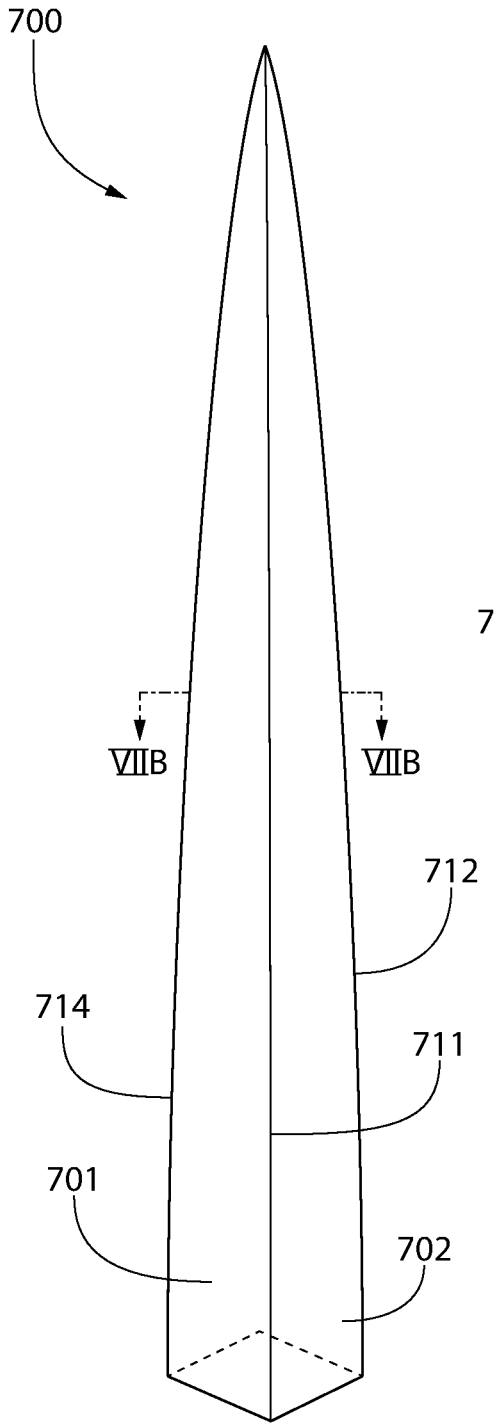
FIG. 7A is a front perspective view of a polygonal bristle in accordance with a second embodiment of the present invention.
Figure 7B:
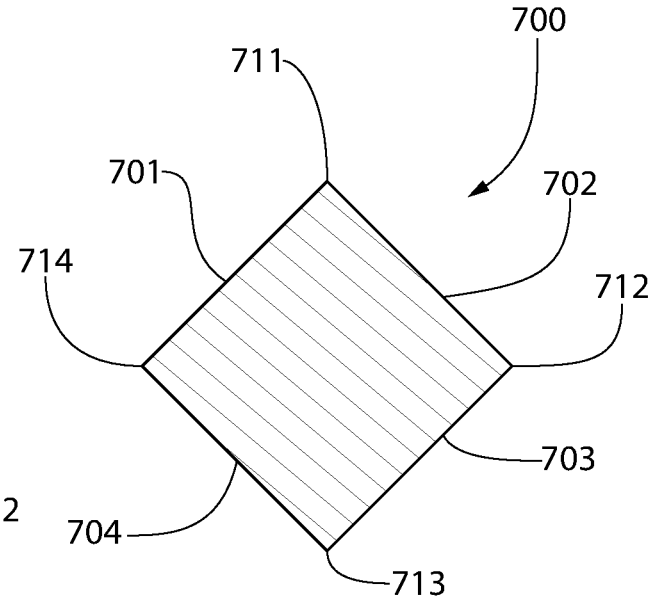
FIG. 7B is a cross-sectional view taken along line VIIB of FIG. 7A.

Referring briefly to FIGS. 7A and 7B, a bristle 700 will be described in accordance with another embodiment of the present invention. The bristle 700 is identical to the bristle 600 except that the bristle 700 has a square or rectangular cross-sectional shape and therefore the bristle 700 has the shape of a square column. Thus, the bristle 700 has four longitudinal surfaces 701, 702, 703, 704 and four longitudinal edges 711, 712, 713, 714 formed at the intersection of each two adjacent longitudinal surfaces 701-704. Other than the additional surface and edge, the bristle 700 is identical to the bristle 600 and thus the description of the bristle 600 above with reference to FIGS. 6A and 6B is applicable.

Figure 8A:
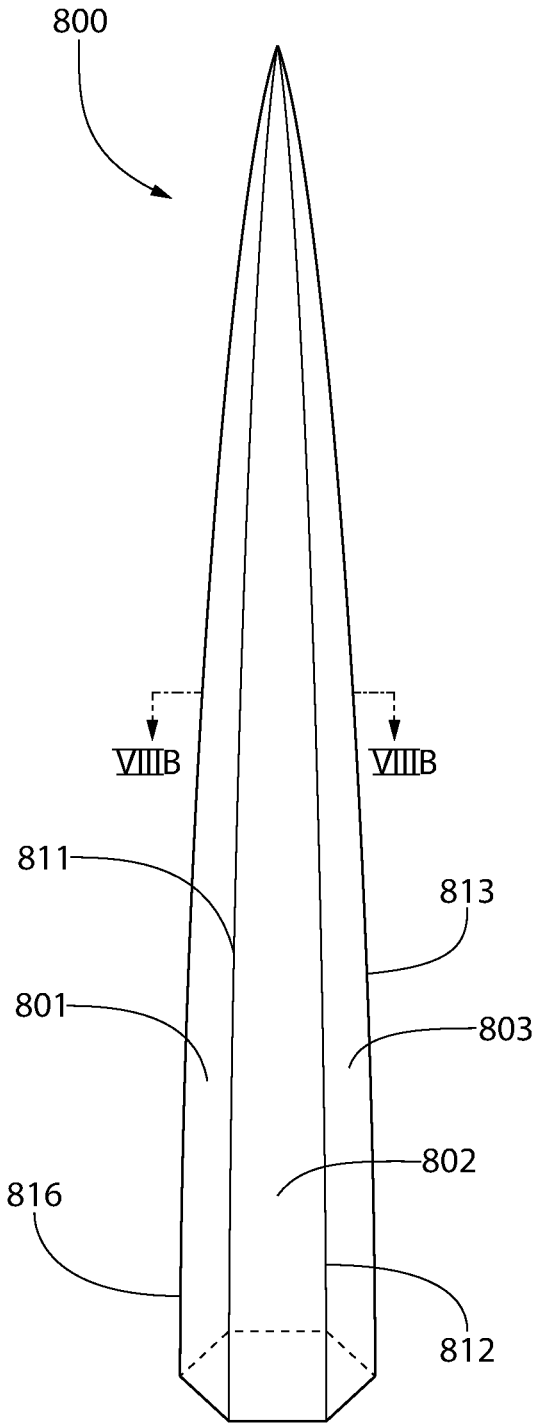
FIG. 8A is a front perspective view of a polygonal bristle in accordance with a third embodiment of the present invention.
Figure 8B:
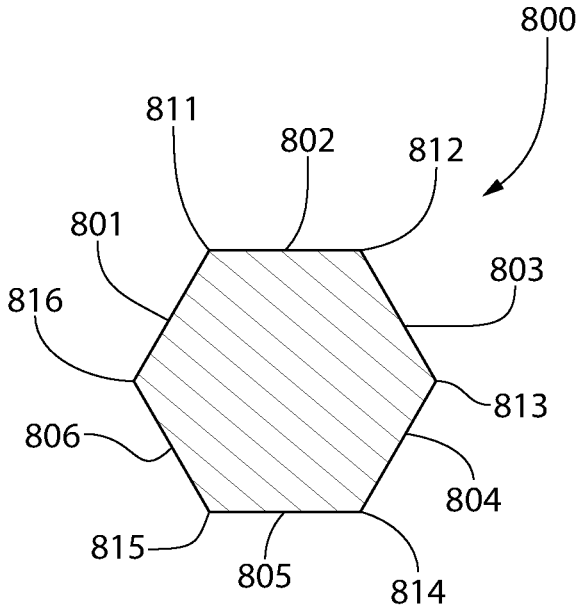
FIG. 8B is a cross-sectional view taken along line VIIIB-VIIIB of FIG. 8A.

Referring briefly to FIGS. 8A and 8B, a bristle 800 will be described. The bristle 800 is identical to the bristle 600 except that the bristle 800 has a hexagonal cross-sectional shape and therefore the bristle 800 has the shape of a hexagonal column. Thus, the bristle 800 has six longitudinal surfaces 801, 802, 803, 804, 805, 806 and six longitudinal edges 811, 812, 813, 814, 815, 816 formed at the intersection of each two adjacent longitudinal surfaces 801-806. Other than the additional surfaces and edges, the bristle 800 is identical to the bristle 600 and thus the description of the bristle 600 above with reference to FIGS. 6A and 6B is applicable. Although only triangular, square/rectangular, and hexagonal shaped bristles are described herein with reference to FIGS. 6A-8B, it should be appreciated that any polygonal shape may be used. Thus, the bristles described herein may be pentagon shaped having five surfaces and five edges, heptagon shaped having seven sides and seven surfaces, octagon shaped having eight surfaces and eight edges, decagon shaped having ten surfaces and ten edges, etc.

The bristle of the present invention is formed (in full or in part) from a composition comprising fibroin powder that is uniformly distributed throughout a polymer. The polymer present in the composition may be a thermoplastic organic polymer. The polymer may be a condensation polymer, such as polyester, polyamide, or a combination thereof. The average molecular weight of the polymer may be at least about 10,000, and preferably at least 30,000, to provide the strength and stiffness needed in a toothbrush bristle.

The polyamide of the present invention may have a linear backbone and be produced by reacting a dicarboxylic acid with a diamine to form a linear condensation polyamide.

Non-limiting examples of dicarboxylic acid include C6 to C12 aliphatic dicarboxylic acids, such as hexanedioic acid (adipic acid), heptanedioic acid (pimelic acid), octanedioic acid (suberic acid), nonanedioic acid (azelaic acid), decanedioic acid (sebacic acid), undecanedioic acid (brassilic acid), dodecanedioic acid, as well as aromatic dicarboxylic acids, such as terephthalic acid and isophthalic acid. Non-limiting examples of diamine may include linear aliphatic or cycloaliphatic diamine, such as ethylene diamine, trimethylene diamine, tetramethylene diamine, pentamethylene diamine, hexamethylene diamine, isophorone diamine, and 1,4,-cyclohexanebis(methylamine). Non-limiting examples of diamine may also include linear aromatic diamine, such as phenylene diamine, and benzidine.

Non-limiting examples of polyamide include a nylon selected from nylon 6,6; nylon 6,10; nylon 6,12. Nylon 6,6 refers to a linear polyamide that is the reaction product of a C6 diamine compound (e.g., hexamethylene diamine) and C6 dicarboxylic acid compound (e.g., adipic acid). Nylon 6,10 refers to a linear polyamide that is the reaction product of a C6 diamine compound (e.g., hexamethylene diamine) and a C10 dicarboxylic acid compound (sebacic acid). Nylon 6,12 refers to a linear polyamide that is the reaction product of a C6 diamine compound (e.g., hexamethylene diamine) and a C12 dicarboxylic acid compound (e.g., dodecanedioic acid).

The polyester of the present invention may have a linear backbone and be produced by reacting a dicarboxylic acid with a diol. Suitable examples of dicarboxylic acids are previously listed. Non-limiting examples of diol may include C2 to C6 aliphatic diol, such as ethylene glycol, trimethylene glycol, butylene glycol, butanediol, pentamethylene, hexamethylene diol. According to the present invention, the polyester may be the reaction product of terephthalic acid and ethylene glycol (i.e., polyethylene terephthalate "PET"). In a preferred embodiment, the polyester may be the reaction product of terephthalic acid and butanediol (i.e., polybutylene terephthalate "PBT").

The fibroin powder may be present in the composition by an amount ranging from about 0.01 wt. % to about 2.0 wt. % based on the total weight of the composition—including all sub-ranges and value there-between. The fibroin powder may be present in the composition by an amount ranging from about 0.05 wt. % to about 1.0 wt. % based on the total weight of the composition—including all sub-ranges and values there-between. In a preferred embodiment, the fibroin powder may be present in the composition in an amount ranging from about 0.1 wt. % to about 0.5 wt. % based on the total weight of the composition.

The fibroin powder may comprise particulates of fibroin protein. Fibroin is an insoluble protein present in the silk created by spiders and moths. Fibroin may be collected by a number of different methodologies including, but not limited to dissolving degummed silk material in at least one solvent, adding a coagulating salt to the aqueous fibroin solution. The fibroin may then be precipitated out of solution to form a gel, followed by dehydrating and drying the gel and pulverizing the solid fibroin by mechanical grinding into a fine fibroin powder that is non-fibrous and in particulate form.

The fibroin powder may be pulverized to obtain a predetermined particle size. The fibroin powder may have a particle size that is less than or equal to about 20 microns; alternatively less than or equal to about 10 microns. In a preferred embodiment, the fibroin powder may have a particle size that is less than or equal to about 5 microns. The fibroin powder may have a particle size ranging from about 0.1 microns to about 10 microns—including all sub-ranges and values there-between. The fibroin powder may have a particle size ranging from about 1 micron to about 5 microns—including all sub-ranges and values there-between. According to the present invention, the term "about" means+/−5% of the referenced value.

It has been discovered that adding fibroin powder to a composition used to form a bristle results in improved glideability as the bristle moves over a surface in an oral cavity (such as a tooth surface or gum surface). Furthermore, by uniformly distributing the fibroin powder throughout the polymer in the composition the bristle will continue to exhibit the desired level of glide-ability even as the outer surface of the bristle wears during use. Having fibroin powder distributed uniformly throughout the composition allows the fibroin to be present throughout the body of the bristle. Thus, unlike a surface coating, any wearing away of the outer surface of the bristle will only expose additional fibroin further contained in the body of the bristle, as demonstrated, for example, in FIG. 2C. Furthermore, it has been discovered that the composition of the present invention used with a bristle having a polygonal cross-sectional geometry gives exceptional cleaning as the glideability of the bristle with the composition coupled with the squeegee nature of the longitudinal edges allows for rapid and efficient collection of contaminants from the oral cavity.

Using fibroin particles may provide a smoother and more comfortable mouth feel during use of the bristles due to the pliancy characteristics that can reduce the friction and sting to the gums. Furthermore, fibroin particles may help absorb moisture and reduce the growth of bacteria due to its porous features. Finally, fibroin particles may facilitate teeth whitening when used in an oral care implement or toothbrush bristle as described herein.

The composition comprising the polymer and the fibroin particles may be formed by mixing fibroin powder with a prepolymer and a curing agent to form a precursor mixture, which is then processed in an extruder. The precursor mixture may be formed before being fed to an extruder by adding the fibroin powder, the prepolymer, and the curing agent together in a pre-mix step that takes place in a mechanical mixer—e.g., a banbury mixer. The precursor mixture can also be formed in the extruder by simultaneously adding the separate fibroin powder to the prepolymer and curing agent.

The prepolymer of the precursor mixture may be a polymer having a number average molecular weight ranging from about 500 to about 5,000 and have carboxylic acid groups (COOH) at the terminal groups of the polymer with an average COOH functionality of two. The backbone of the prepolymer may correspond to the final polymer type being desired—i.e. for polyester polymer the prepolymer has a polyester backbone; for polyamide polymer the prepolymer has a polyamide backbone. The curing agent may comprise low molecular weight di-functional monomer that can react with the carboxylic acid groups present on the prepolymer, thereby curing the prepolymer to form the final polymer. For polyester, the curing agent may comprise the aforementioned diol compounds and for polyamide, the curing agent may comprise the aforementioned diamine compounds.

After forming the precursor mixture, it may be then fed to an extruder. The extruder may be a single screw extruder or a twin screw extruder. The extruder may comprise one or more processing zones—including, but not limited to, a feed zone, a processing zone, and shaping die. The feed zone collects the precursor mixture as it is fed to the extruder. The processing zone may comprise a plurality of sub-zones.

Non-limiting examples of sub-zones include a melting zone, a metering zone, and a degassing zone. As the precursor passes through the processing zone, a plurality of heating elements that heat the precursor mixture to a temperature ranging from 240° C. to about 290° C. The temperature is above both the melting temperature of the prepolymer thereby melting the prepolymer into a molten state. As the screw(s) of the extruder rotate, the molten precursor is further mixed as it is conveyed toward the shaping die. Additional mixing may further ensure a uniform distribution of the fibroin powder in the final composition. As the molten precursor continues through the extruder, the processing temperature reaches or is slightly above the reaction temperature of the prepolymer and curing agent, thereby causing the free COOH groups present on the prepolymer to react with the curing agent and form the final polymer. The cured or semi-cured composition continues through the extruder and reaches the shaping die.

The shaping die may comprise at least one outlet having a predetermined shape for the composition to pass through. The predetermined shape may be circular, ovular, or polygonal. Non-limiting examples of polygonal shapes include triangular, rectangular, trapezoidal, pentagonal, and hexagonal. The shape of the die outlet may control the traverse cross-sectional geometry of the resulting bristle. The bristles of the present invention may have a transverse cross-section that is circular, ovular, or polygonal. Non-limiting examples of polygonal cross-section geometries include triangular, rectangular (including oblong rectangle and squares), parallelogram, trapezoidal, pentagonal, or hexagonal. As the composition passes through the shaping die, it forms a continuous bulk filament of the composition having a predetermined cross-sectional area dictated by the dimensions of the die opening.

Processing concerns related to the extruder may limit how small the cross-sectional area of the extruded bulk filament may be at the time of leaving the shaping die. The bristle according to the present invention, however, may require a maximum cross-sectional area that is a fraction of the cross-sectional area of the bulk filament as it leaves the shaping die. Thus, the present invention may further include a spin drawing step that not only elongates the bulk filament but simultaneously decreases the cross-sectional area to a value that is appropriate for the bristle of the present invention—thereby producing a bristle filament. The spin drawing step may be performed on a spinneret while the bulk filament is at or above the melting temperature of the polymer in the composition. After being spun-drawn by the spinneret, the resulting bristle filament may be collected onto a feed roll.

The feed roll may later be transferred to a toothbrush manufacturing station where predetermined lengths of the bristle filament are cut from the feed roll and used to form the bristles of the present invention. After cutting the lengths of the bristle filament, each cut section may be further processed so that the final bristles are tapered or the distal tip portion is end rounded. The bristles may be tapered by a chemical process (such as dipping in an acid bath) or mechanical process (such as grinding). The bristles may be end rounded by a mechanical process.

Although the invention has been described herein with regard to an oral care implement having at least one bristle tuft having at least one multi-component bristle, in certain embodiments the inventive concept described herein is the multi-component bristle itself. Thus, the invention can simply be a multi-component bristle including coextruded core and sheath components wherein the core component comprises a first plastic and a first oral care additive and the sheath component comprises a second plastic and a second oral care additive, the second oral care additive being different than the first oral care additive.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A method of forming bristles comprising:

a) forming a fibroin powder by dissolving a degummed silk material in at least one solvent to form a fibroin solution, adding a coagulating salt to the fibroin solution, precipitating a fibroin precipitate from the fibroin solution, and drying and grinding the fibroin precipitate into fibroin particles;

b) mixing the fibroin particles into a polymer resin to form a mixture; and c) forming a plurality of bristles from the mixture.

2. The method according to claim 1, wherein step b) comprises:

b-1) extruding the mixture through a die to form extruded strands; and b-2) cutting the extruded strands to form the bristles.

3. The method of claim 2, wherein the mixture passes through the extruder at a temperature ranging from about 240° C. to about 290° C.

4. The method according to claim 2, wherein the die has a circular porthole.

5. The method according to claim 2, wherein the die has a polygonal porthole.

6. The method according to claim 1, wherein the fibroin particles are present in the mixture in an amount ranging from about 0.1 to about 0.5 wt. % based on the total weight of the mixture.

7. The method according of claim 1, wherein the fibroin particles have a particle size that is less than or equal to about 5 microns.

8. The method according to claim 1, wherein the polymer resin is a condensation polymer.

* * * * *